US009805667B2

(12) United States Patent
Deng

(10) Patent No.: US 9,805,667 B2
(45) Date of Patent: Oct. 31, 2017

(54) BRIGHTNESS COMPENSATION METHOD OF MURA AREA AND DESIGN METHOD OF MURA PIXEL DOT BRIGHTNESS

(71) Applicant: Shenzhen China Star Optoelectronics Technology Co., Ltd., Shenzhen (CN)

(72) Inventor: Yufan Deng, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 120 days.

(21) Appl. No.: 14/894,367

(22) PCT Filed: Oct. 12, 2015

(86) PCT No.: PCT/CN2015/091722

§ 371 (c)(1),
(2) Date: Nov. 26, 2015

(87) PCT Pub. No.: WO2017/035910

PCT Pub. Date: Mar. 9, 2017

(65) Prior Publication Data

US 2017/0193928 A1 Jul. 6, 2017

(51) Int. Cl.
*G09G 3/34* (2006.01)
*G09G 3/00* (2006.01)
(Continued)

(52) U.S. Cl.
CPC ..... *G09G 3/3426* (2013.01); *G09G 3/006* (2013.01); *G09G 3/3208* (2013.01);
(Continued)

(58) Field of Classification Search
CPC ..... G09G 5/10; G09G 2320/0233; G09G 3/3648; G09G 2320/02; G09G 2320/0242;
(Continued)

(56) References Cited

U.S. PATENT DOCUMENTS

| | | | | |
|---|---|---|---|---|
| 9,437,171 | B2 * | 9/2016 | Narasimha | G09G 5/377 |
| 2005/0068330 | A1 * | 3/2005 | Speigle | H04N 1/6086 345/589 |
| 2010/0110112 | A1 * | 5/2010 | Nakanishi | G09G 3/3426 345/690 |

* cited by examiner

*Primary Examiner* — Dmitriy Bolotin
(74) *Attorney, Agent, or Firm* — Leong C. Lei

(57) ABSTRACT

The present invention provides a brightness compensation method of a Mura area and a design method of a Mura pixel dot brightness. By searching the right and lower normal pixel dots which are closest to the designated Mura pixel dot, and respectively recording the brightnesses of the right and lower normal pixel dots, and the distances between the right and lower normal pixel dots and the designated pixel dot, with combination of the brightnesses of the left and upper normal pixel dots adjacent to the designated Mura pixel dot, the weighted operation is executed to the brightnesses of the normal pixel dots at the right side, the lower side, the left side and the upper side to obtain the ideal brightness of the designated Mura pixel dot, and replace the original brightness of the designated Mura pixel dot with the obtained ideal brightness. Then, the brightness compensation of the Mura area is accomplished. The brightness of the Mura area after compensation is smoothly transited.

10 Claims, 5 Drawing Sheets

(51) Int. Cl.
*G09G 3/36* (2006.01)
*G09G 3/3208* (2016.01)

(52) U.S. Cl.
CPC ..... *G09G 3/3611* (2013.01); *G09G 3/3644* (2013.01); *G09G 3/3648* (2013.01); *G09G 2320/0233* (2013.01); *G09G 2320/0646* (2013.01); *G09G 2330/10* (2013.01); *G09G 2360/147* (2013.01); *G09G 2360/16* (2013.01)

(58) Field of Classification Search
CPC ..... G09G 2320/0261; G09G 3/2022; G09G 3/2051; G09G 3/3426; G09G 3/006; G09G 3/3644; G09G 3/3611; G09G 3/3208; G09G 2320/0646; G09G 2360/16; G09G 2360/147; G09G 2330/10
See application file for complete search history.

BRIGHTNESS COMPENSATION METHOD OF MURA AREA AND DESIGN METHOD OF MURA PIXEL DOT BRIGHTNESS

FIELD OF THE INVENTION

The present invention relates to a display technology field, and more particularly to a brightness compensation method of a Mura area and a design method of a Mura pixel dot brightness.

BACKGROUND OF THE INVENTION

A flat panel display possesses advantages of being ultra thin, power saved and radiation free and has been widely utilized. The present flat panel display devices at present mainly comprise the Liquid Crystal Display (LCD) and the Organic Light Emitting Display (OLED).

With the development of technology and the demands for the material life of the people, the size of the present flat panel display gets larger and larger, and the display resolution becomes higher and higher. The requirement to the production is increasingly severe, too. In the present production procedure of the flat panel display, the Mura defects often happen due to the reasons, such as the production processes. The Mura means kinds of mark appearances caused by the nonuniform brightness of the display panel. In the dark room, the display panel is switched to the black image and other low gray scale images, and then, the existence of Mura in the display panel can be determined by watching from respective different angles whether marks exist in the display image. Such marks can be vertical strips or forty-five angle strips, the blocks which are straightly cut, one block showing at some corner, or marks with no rules. Generally, the display area showing kinds of respective marks is so called the Mura area.

Against the Mura area of the display area, the common process method is: obtaining the screen brightness information, and detecting Mura, and compensating the brightness of the Mura area to be an ideal brightness. The present calculation ways of the ideal brightness of the Mura area comprises: calculation according Gamma value and filtering acquisition.

Please refer to FIG. 1. The method of calculation according Gamma value is to adjust the Gamma value of the Mura area to be consistent with the Gamma value of the normal area, and thus to promote the uniformity of the panel and reduce the possibility that the Mura is aware. However, in practical operation, the display panel itself definitely has acceptable nonuniform brightness of certain level. The ideal brightness calculated by the Gamma value is generally applicable to the center point of the display panel but the position of the Mura area is random. Therefore, the brightnesses of the normal areas around the Mura area may not be equal to the brightness of the center point. With such calibration of Mura, as shown in FIG. 1, the brightness of the Mura area may be inconsistent with the variation trend of the brightnesses around, and new nonuniformity is introduced.

The method of filtering acquisition is to filter and smooth the brightness matrix to obtain a new brightness matrix. The respective pixel dots of new brightness matrix and the original brightness matrix are divided dot by dot to acquire the brightness adjustment coefficients of the respective pixels. Although the filtering can smooth the borders of the Mura area, the other normal area can be affected. As adjusting the brightness of the Mura area, the brightness of the normal area has to be adjusted, too. The operation difficulty for the control of smooth degree, the setting of the filtering parameters is higher. For the Mura area of which the brightness difference is larger or the area is large, the smooth effect is limited.

Therefore, there is a need for a better brightness compensation method of a Mura area to make the brightness of the Mura area after compensation be smoothly transited.

SUMMARY OF THE INVENTION

An objective of the present invention is to provide a brightness compensation method of a Mura area, which can compensate the brightnesses of respective Mura pixel dots in a Mura area, and the brightness of the Mura area after compensation is smoothly transited, which is capable of promoting the production yield of the display panel and improving the display quality of the display panel.

Another objective of the present invention is to provide a design method of a Mura pixel dot brightness, which can obtain an ideal brightness of a Mura pixel dot to compensate the brightness of the Mura pixel dot, and the brightness of the Mura pixel dot after compensation is smoothly transited, which is capable of promoting the production yield of the display panel and improving the display quality of the display panel.

For realizing the aforesaid objectives, the present invention first provides a brightness compensation method of a Mura area, comprising steps of:

step 1, providing a display panel, and the display panel comprises a plurality of pixel dots aligned in array, and the display panel comprises a Mura area and a normal area;

step 2, obtaining a brightness matrix of the display panel, and marking the Mura area, and searching and designating a first Mura pixel dot in the Mura area;

step 3, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 4, searching a left normal pixel dot and an upper normal pixel dot positioned at a left side and an upper side of the designated pixel dot, and respectively recording brightnesses of the left and upper normal pixel dots;

step 5, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated Mura pixel dot, and replace an original brightness of the designated Mura pixel dot with the obtained ideal brightness;

step 6, searching and designating a next Mura pixel dot in the Mura area, and repeating the step 3 to the step 5 until all Mura pixel dots in the Mura area are processed to accomplish brightness compensation to the Mura area of the display panel.

Searching and designating the Mura pixel dots in the Mura area is proceeded by following the orders from left to right, from top to bottom.

A weighted operation formula in the step 5 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4},$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

In case that one designated Mura pixel dot in the Mura area is a pixel dot of first row, first column, a brightness of the normal pixel dot, of which the Euclidean distance with the pixel dot of first row, first column is shortest, is employed to be the ideal brightness, and the ideal brightness is employed to replace an original brightness of the pixel dot of first row, first column.

The Mura area is at an arbitrary position in the display panel.

The present invention further provides a design method of a Mura pixel dot brightness, comprising steps of:

step 1, providing a display panel having Mura pixel dots and normal pixel dots, and searching and designating one Mura pixel dot in the display panel;

step 2, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 3, searching a left normal pixel dot and an upper normal pixel dot positioned at a left side and an upper side of the designated pixel dot, and respectively recording brightnesses of the left and upper normal pixel dots;

step 4, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated pixel dot.

A weighted operation formula in the step 4 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4},$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

In case that the designated Mura pixel dot is a pixel dot of first row, first column, a brightness of the normal pixel dot, of which the Euclidean distance with the pixel dot of first row, first column is shortest, is employed to be the ideal brightness.

In the step 1, the Mura pixel dot is searched and designated with the brightness matrix of the display panel.

The present invention further provides a brightness compensation method of a Mura area, comprising steps of:

step 1, providing a display panel, and the display panel comprises a plurality of pixel dots aligned in array, and the display panel comprises a Mura area and a normal area;

step 2, obtaining a brightness matrix of the display panel, and marking the Mura area, and searching and designating a first Mura pixel dot in the Mura area;

step 3, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 4, searching a left normal pixel dot and an upper normal pixel dot positioned at a left side and an upper side of the designated pixel dot, and respectively recording brightnesses of the left and upper normal pixel dots;

step 5, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated Mura pixel dot, and replace an original brightness of the designated Mura pixel dot with the obtained ideal brightness;

step 6, searching and designating a next Mura pixel dot in the Mura area, and repeating the step 3 to the step 5 until all Mura pixel dots in the Mura area are processed to accomplish brightness compensation to the Mura area of the display panel;

wherein searching and designating the Mura pixel dots in the Mura area is proceeded by following the orders from left to right, from top to bottom;

wherein a weighted operation formula in the step 5 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4}$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0;

wherein in case that one designated Mura pixel dot in the Mura area is a pixel dot of first row, first column, a brightness of the normal pixel dot, of which the Euclidean distance with the pixel dot of first row, first column is shortest, is employed to be the ideal brightness, and the ideal brightness is employed to replace an original brightness of the pixel dot of first row, first column.

wherein the Mura area is at an arbitrary position in the display panel.

The benefits of the present invention are: the present invention provides a brightness compensation method of a Mura area and a design method of a Mura pixel dot brightness. By searching the right and lower normal pixel dots which are closest to the designated Mura pixel dot, and respectively recording the brightnesses of the right and lower normal pixel dots, and the distances between the right and lower normal pixel dots and the designated pixel dot, with combination of the brightnesses of the left and upper normal pixel dots adjacent to the designated Mura pixel dot, the weighted operation is executed to the brightnesses of the normal pixel dots at the right side, the lower side, the left side and the upper side to obtain the ideal brightness of the designated Mura pixel dot, and replace the original brightness of the designated Mura pixel dot with the obtained ideal brightness. Then, the brightness compensation of the Mura area is accomplished. The brightness of the Mura area after compensation is smoothly transited, which is capable of promoting the production yield of the display panel and improving the display quality of the display panel.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
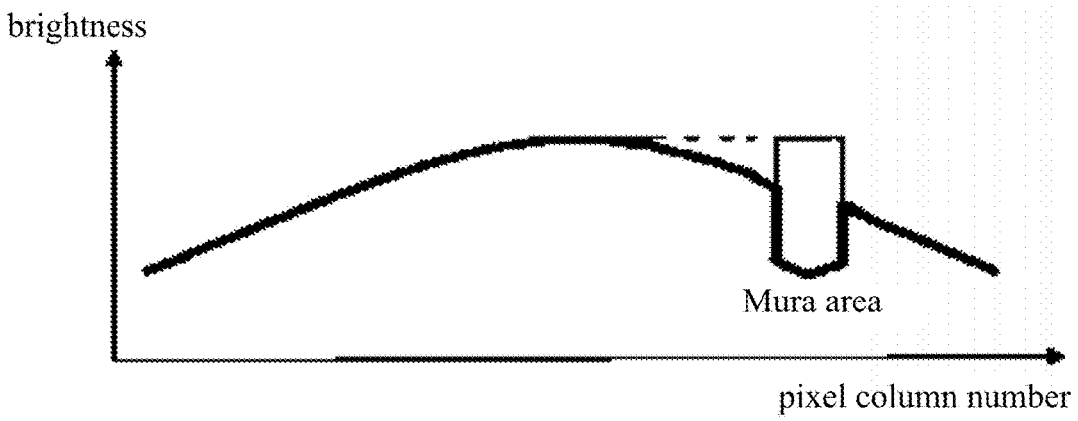
FIG. 1 is a brightness conversion curve of the pixels of respective columns of the display panel after calculating and compensating the brightness of the Mura area with Gamma value according to prior art.
Figure 2:
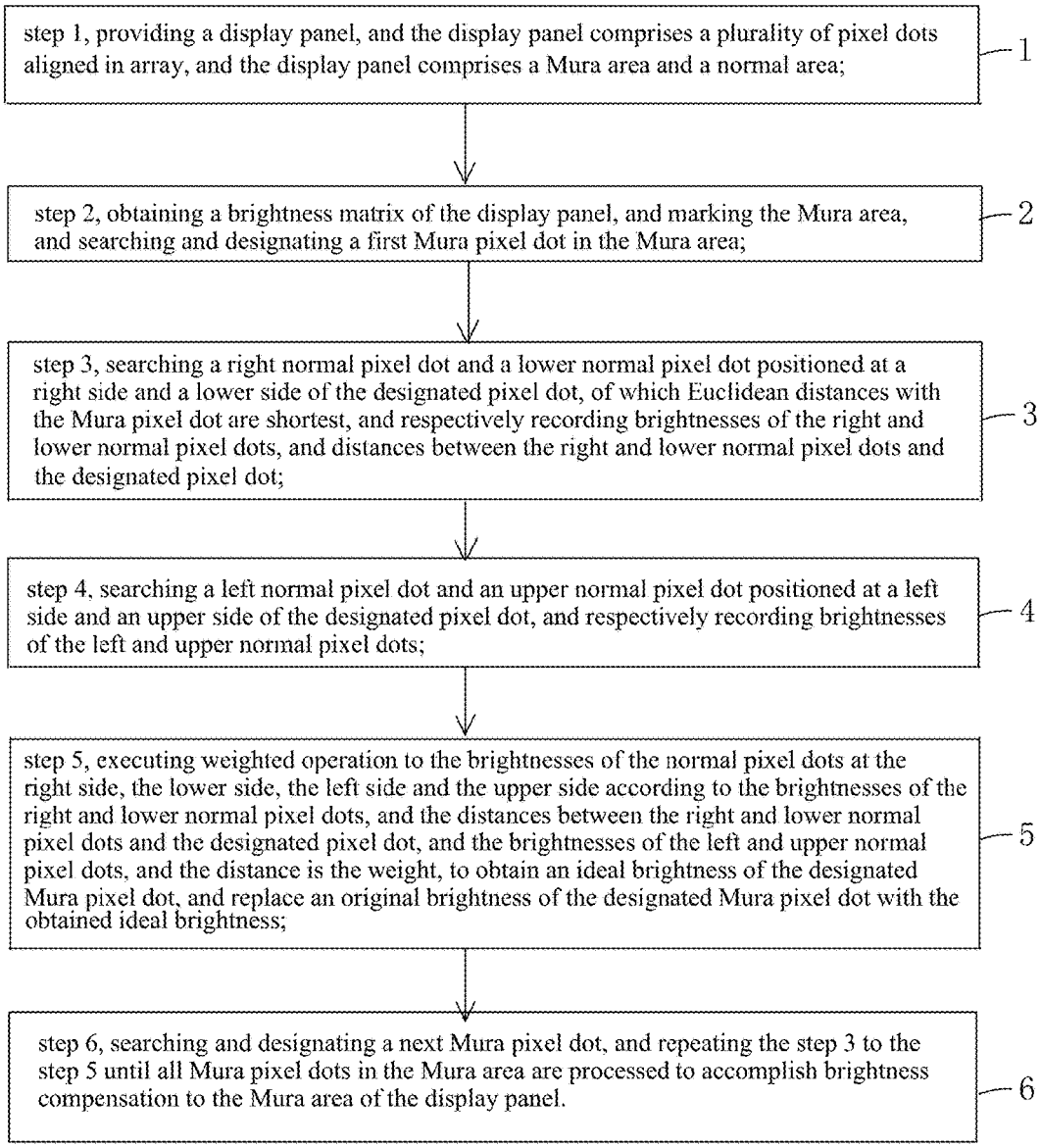
FIG. 2 is a flowchart of a brightness compensation method of a Mura area according to the present invention.

Please refer to FIG. 2. The present invention first provides a brightness compensation method of a Mura area, comprising steps of:

step 1, providing a display panel, and the display panel comprises a plurality of pixel dots aligned in array, and the display panel comprises a Mura area and a normal area;

The Mura area can be at an arbitrary position in the display panel. The amount of the Mura areas can be one or more, which is determined according to the Mura detection result of the display panel.

step 2, obtaining a brightness matrix of the display panel, and marking the Mura area, and searching and designating a first Mura pixel dot in the Mura area.

Figure 4:
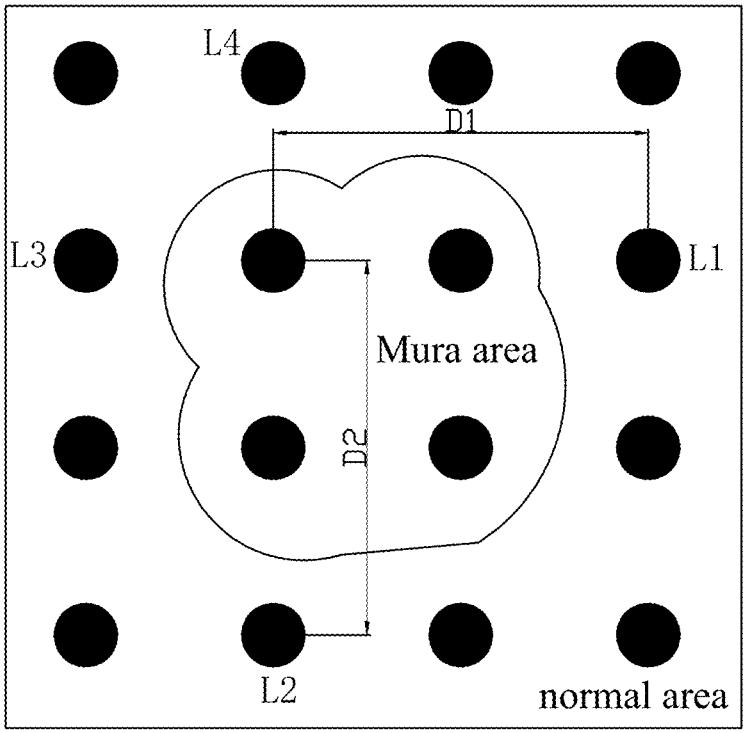
FIG. 4 is a diagram of the step 3 and the step 4 in the brightness compensation method of the Mura area according to the present invention and the step 2 and the step 3 in the design method of the Mura pixel dot brightness according to the present invention.

Specifically, in the marked Mura area, searching and designating a first Mura pixel dots in the Mura area is proceeded by following the orders of from left to right, from top to bottom.

step 3, referring to FIG. 4, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot.

step 4, referring to FIG. 4, searching a left normal pixel dot and an upper normal pixel dot positioned at a left side and an upper side of the designated pixel dot, and respectively recording brightnesses of the left and upper normal pixel dots.

step 5, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated Mura pixel dot, and replace an original brightness of the designated Mura pixel dot with the obtained ideal brightness.

Specifically, a weighted operation formula in the step 5 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4}$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

Particularly, when the Mura pixel dot is the pixel dot of first column, there will be no left normal pixel dot existing, i.e. F3=0; when the Mura pixel dot is the pixel dot of first row, there will be no upper normal pixel dot existing, i.e. F4=0. In case that one designated Mura pixel dot in the Mura area is a pixel dot of first row, first column, a brightness of the normal pixel dot, of which the Euclidean distance with the pixel dot of first row, first column is shortest, is employed to be the ideal brightness.

step 6, searching and designating a next Mura pixel dot in the Mura area by following the orders of from left to right, from top to bottom, and repeating the step 3 to the step 5 until all Mura pixel dots in the Mura area are processed to accomplish brightness compensation to the Mura area of the display panel.

FIG. 4 is illustrated, the first Mura pixel dot in the Mura area is the pixel dot of second row, second column, and the right normal pixel dot is the pixel dot of second row, fourth column, the lower normal pixel dot is the pixel dot of fourth row, second column, and the left normal pixel dot is the pixel dot of second row, first column, and the upper normal pixel dot is the pixel dot of first row, second column. After the normal pixel dots of four directions have been searched, the ideal brightness of the Mura pixel dot at second row, second column is calculated, and the calculated ideal brightness is employed to replace the original brightness. Then, the Mura pixel dot at second row, third column, the Mura pixel dot at third row, second column, the Mura pixel dot at third row, third column in the Mura area are continuously to be processed in orders until the processes to all the Mura pixel dots are finished to accomplish the brightness compensation to the Mura area shown in FIG. 4.

Figure 5:
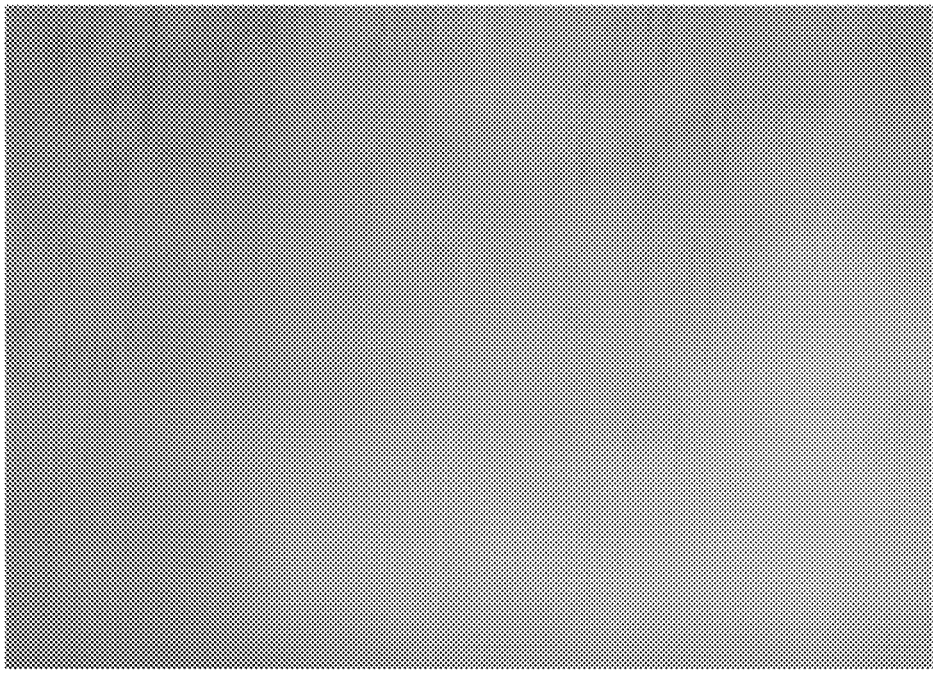
FIG. 5 is an original display effect diagram of a display panel.
Figure 6:
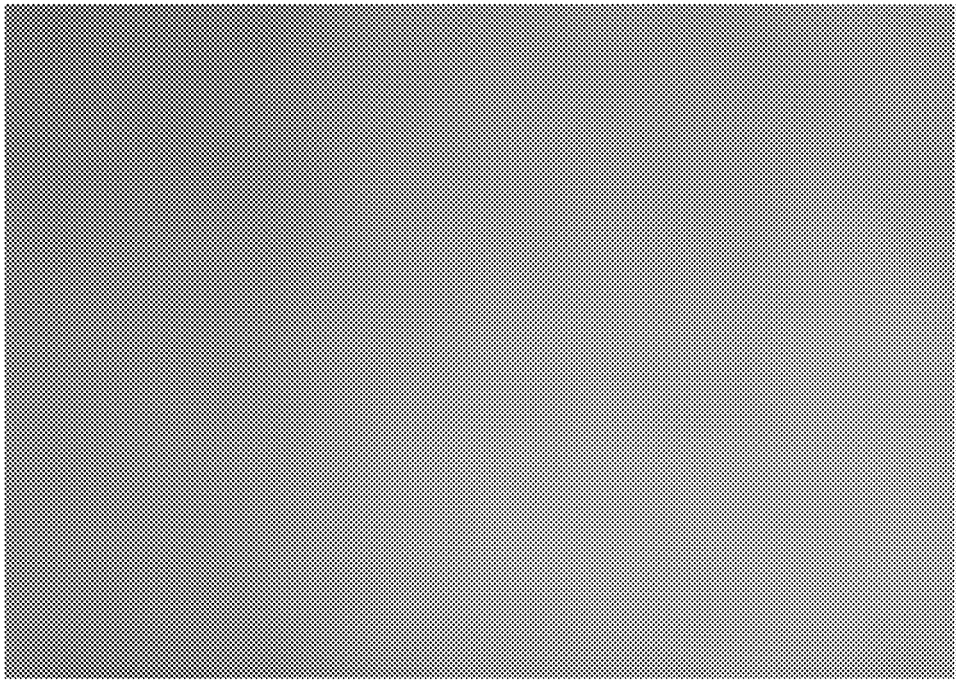
FIG. 6 is a display effect diagram of a display panel after being compensated by the brightness compensation method of the Mura area according to the present invention.

Please compare FIG. 5 and FIG. 6. FIG. 5 shows an original display effect of a display panel which is not compensated. The brightness of the Mura area is not uniform. FIG. 6 shows that the brightness of the Mura area after being compensated by the brightness compensation method of the Mura area according to the present invention is smoothly transited, which is capable of promoting the production yield of the display panel and improving the display quality of the display panel.

Figure 3:
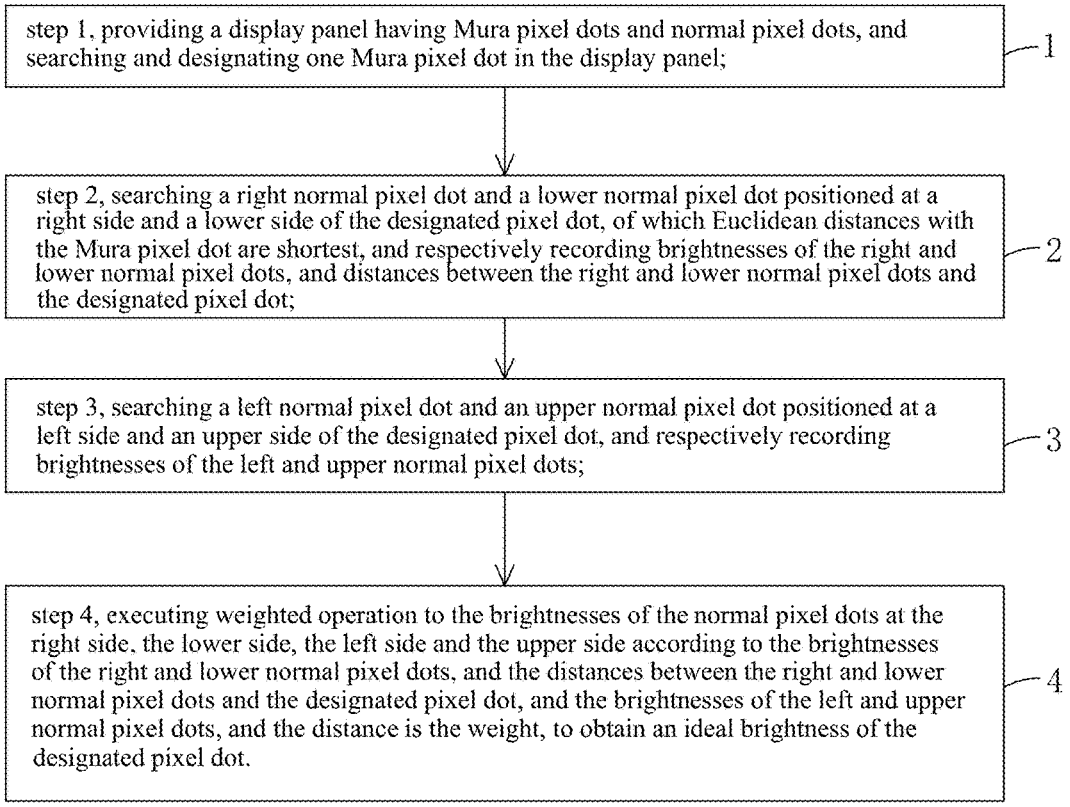
FIG. 3 is a flowchart of a design method of a Mura pixel dot brightness according to the present invention.

Please refer to FIG. 3. On the basis of the same inventive idea, the present invention further provides a design method of a Mura pixel dot brightness, comprising steps of:

step 1, providing a display panel having Mura pixel dots and normal pixel dots, and searching and designating one Mura pixel dot in the display panel;

Specifically, the Mura pixel dot can be at an arbitrary position in the display panel and can be searched and designated with the brightness matrix of the display panel.

step 2, referring to FIG. 4, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot.

step 3, referring to FIG. 4, searching a left normal pixel dot and an upper normal pixel dot positioned at a left side and an upper side of the designated pixel dot, and respectively recording brightnesses of the left and upper normal pixel dots.

step 4, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated pixel dot.

Specifically, a weighted operation formula in the step 4 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4}$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

Particularly, when the designated Mura pixel dot is the pixel dot of first column, there will be no left normal pixel dot existing, i.e. F3=0; when the Mura pixel dot is the pixel dot of first row, there will be no upper normal pixel dot existing, i.e. F4=0. In case that the designated Mura pixel dot is a pixel dot of first row, first column, a brightness of the normal pixel dot, of which the Euclidean distance with the pixel dot of first row, first column is shortest, is employed to be the ideal brightness.

After the ideal brightness of the Mura pixel dot is calculated, the calculated ideal brightness can be employed to replace the original brightness of the Mura pixel dot to achieve the objective of brightness compensation.

In conclusion, in the brightness compensation method of the Mura area and the design method of the Mura pixel dot brightness according to the present invention, by searching the right and lower normal pixel dots which are closest to the designated Mura pixel dot, and respectively recording the brightnesses of the right and lower normal pixel dots, and the distances between the right and lower normal pixel dots and the designated pixel dot, with combination of the brightnesses of the left and upper normal pixel dots adjacent to the designated Mura pixel dot, the weighted operation is executed to the brightnesses of the normal pixel dots at the right side, the lower side, the left side and the upper side to obtain the ideal brightness of the designated Mura pixel dot, and replace the original brightness of the designated Mura pixel dot with the obtained ideal brightness. Then, the brightness compensation of the Mura area is accomplished. The brightness of the Mura area after compensation is smoothly transited, which is capable of promoting the production yield of the display panel and improving the display quality of the display panel.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A brightness compensation method of a Mura area, comprising steps of:

step 1, providing a display panel, and the display panel comprises a plurality of pixel dots aligned in array, and the display panel comprises a Mura area and a normal area;

step 2, obtaining a brightness matrix of the display panel, and marking the Mura area, and searching and designating a first Mura pixel dot in the Mura area;

step 3, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 4, searching a left normal pixel dot and an upper normal pixel dot positioned at a left side and an upper side of the designated pixel dot, and respectively recording brightnesses of the left and upper normal pixel dots;

step 5, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated Mura pixel dot, and replace an original brightness of the designated Mura pixel dot with the obtained ideal brightness;

step 6, searching and designating a next Mura pixel dot in the Mura area, and repeating the step 3 to the step 5 until all Mura pixel dots in the Mura area are processed to accomplish brightness compensation to the Mura area of the display panel.

2. The brightness compensation method of the Mura area according to claim 1, wherein searching and designating the Mura pixel dots in the Mura area is proceeded by following the orders from left to right, from top to bottom.

3. The brightness compensation method of the Mura area according to claim 1, wherein a weighted operation formula in the step 5 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4}$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

4. The brightness compensation method of the Mura area according to claim 3, wherein in case that one designated Mura pixel dot in the Mura area is a pixel dot of first row, first column, a brightness of the normal pixel dot, of which the Euclidean distance with the pixel dot of first row, first column is shortest, is employed to be the ideal brightness, and the ideal brightness is employed to replace an original brightness of the pixel dot of first row, first column.

5. The brightness compensation method of the Mura area according to claim 1, wherein the Mura area is at an arbitrary position in the display panel.

6. A design method of a Mura pixel dot brightness, comprising steps of:

step 1, providing a display panel having Mura pixel dots and normal pixel dots, and searching and designating one Mura pixel dot in the display panel;

step 2, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 3, searching a left normal pixel dot and an upper normal pixel dot positioned at a left side and an upper side of the designated pixel dot, and respectively recording brightnesses of the left and upper normal pixel dots;

step 4, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated pixel dot.

7. The design method of the Mura pixel dot brightness according to claim 6, wherein a weighted operation formula in the step 4 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4},$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0.

8. The design method of the Mura pixel dot brightness according to claim 7, wherein in case that the designated Mura pixel dot is a pixel dot of first row, first column, a brightness of the normal pixel dot, of which the Euclidean distance with the pixel dot of first row, first column is shortest, is employed to be the ideal brightness.

9. The design method of the Mura pixel dot brightness according to claim 6, wherein in the step 1, the Mura pixel dot is searched and designated with the brightness matrix of the display panel.

10. A brightness compensation method of a Mura area, comprising steps of:

step 1, providing a display panel, and the display panel comprises a plurality of pixel dots aligned in array, and the display panel comprises a Mura area and a normal area;

step 2, obtaining a brightness matrix of the display panel, and marking the Mura area, and searching and designating a first Mura pixel dot in the Mura area;

step 3, searching a right normal pixel dot and a lower normal pixel dot positioned at a right side and a lower side of the designated pixel dot, of which Euclidean distances with the Mura pixel dot are shortest, and respectively recording brightnesses of the right and lower normal pixel dots, and distances between the right and lower normal pixel dots and the designated pixel dot;

step 4, searching a left normal pixel dot and an upper normal pixel dot positioned at a left side and an upper side of the designated pixel dot, and respectively recording brightnesses of the left and upper normal pixel dots;

step 5, executing weighted operation to the brightnesses of the normal pixel dots at the right side, the lower side, the left side and the upper side according to the brightnesses of the right and lower normal pixel dots, and the distances between the right and lower normal pixel dots and the designated pixel dot, and the brightnesses of the left and upper normal pixel dots, and the distance is the weight, to obtain an ideal brightness of the designated Mura pixel dot, and replace an original brightness of the designated Mura pixel dot with the obtained ideal brightness;

step 6, searching and designating a next Mura pixel dot in the Mura area, and repeating the step 3 to the step 5 until all Mura pixel dots in the Mura area are processed to accomplish brightness compensation to the Mura area of the display panel;

wherein searching and designating the Mura pixel dots in the Mura area is proceeded by following the orders from left to right, from top to bottom;

wherein a weighted operation formula in the step 5 is:

$$Li = \frac{F1 \times \frac{L1}{D1} + F2 \times \frac{L2}{D2} + F3 \times L3 + F4 \times L4}{\frac{F1}{D1} + \frac{F2}{D2} + F3 + F4}$$

wherein Li is the ideal brightness of the designated Mura pixel dot, and L1 is the brightness of the right normal pixel dot, and L2 is the brightness of the lower normal pixel dot, and L3 is the brightness of the left normal pixel dot, and L4 is the brightness of the upper normal pixel dot, and D1 is the distance between the right normal pixel dot and the designated Mura pixel dot, and D2 is the distance between the lower normal pixel dot and the designated Mura pixel dot; F1 is an existing coefficient of the right normal pixel dot, and in case that the right normal pixel dot exists, F1=1, and in case that the right normal pixel dot does not exist, F1=0; F2 is an existing coefficient of the lower normal pixel dot, and in case that the lower normal pixel dot exists, F2=1, and in case that the lower normal pixel dot does not exist, F2=0; F3 is an existing coefficient of the left normal pixel dot, and in case that the left normal pixel dot exists, F3=1, and in case that the left normal pixel dot does not exist, F3=0; F4 is an existing coefficient of the upper normal pixel dot, and in case that the upper normal pixel dot exists, F4=1, and in case that the upper normal pixel dot does not exist, F4=0;

wherein in case that one designated Mura pixel dot in the Mura area is a pixel dot of first row, first column, a brightness of the normal pixel dot, of which the Euclidean distance with the pixel dot of first row, first column is shortest, is employed to be the ideal brightness, and the ideal brightness is employed to replace an original brightness of the pixel dot of first row, first column; and wherein the Mura area is at an arbitrary position in the display panel.

* * * * *